US012150578B2

(12) United States Patent
Hu et al.

(10) Patent No.: US 12,150,578 B2
(45) Date of Patent: Nov. 26, 2024

(54) CHRISTMAS TREE WITH SHAPE CHANGEABLE BY ADJUSTING ANGLE OF BRANCHES

(71) Applicants: PingYen Hu, Guangdong (CN); YanTao Hou, Guangdong (CN)

(72) Inventors: PingYen Hu, Guangdong (CN); YanTao Hou, Guangdong (CN)

( * ) Notice: Subject to any disclaimer, the term of this patent is extended or adjusted under 35 U.S.C. 154(b) by 293 days.

(21) Appl. No.: 17/901,243

(22) Filed: Sep. 1, 2022

(65) Prior Publication Data

US 2022/0408956 A1 Dec. 29, 2022

(30) Foreign Application Priority Data

Jul. 4, 2022 (CN) ..... 202221699590.8

(51) Int. Cl.
*A47G 33/06* (2006.01)
*A47G 33/12* (2006.01)

(52) U.S. Cl.
CPC ..... *A47G 33/06* (2013.01); *A47G 33/12* (2013.01)

(58) Field of Classification Search
CPC ..... A47G 33/06; A47G 1/007
See application file for complete search history.

(56) References Cited

U.S. PATENT DOCUMENTS 3,806,399 A * 4/1974 Cocjin ..... A47G 33/06 362/123
3,970,834 A * 7/1976 Smith ..... A47G 33/06 362/123
6,422,915 B1 * 7/2002 Chen ..... A63H 33/00 446/175
7,122,230 B1 * 10/2006 Maskell ..... A41G 1/007 428/18
7,267,852 B1 * 9/2007 Rosado ..... A47G 33/06 428/20
2018/0028009 A1 * 2/2018 Ocegueda Gallaga ..... A47G 33/12

FOREIGN PATENT DOCUMENTS

CN 216256611 U 4/2022

* cited by examiner

*Primary Examiner* — Mark Ruthkosky
*Assistant Examiner* — Julia L Rummel
(74) *Attorney, Agent, or Firm* — Muncy, Geissler, Olds & Lowe, P.C.

(57) ABSTRACT

The present disclosure discloses a Christmas tree with a shape changeable by adjusting an angle of branches. The Christmas tree includes a base, a column arranged on the base, and one or more layers of branches arranged on the column. Branch fixing frames are arranged around the column. The branches are rotatably arranged on the branch fixing frames. The base is provided with a branch adjusting structure. The branch adjusting structure includes an adjusting frame movably sleeved outside the column, a support member for supporting the adjusting frame, and a push rod motor for driving the support member to move up and down to push the branches for angle adjustment. During angle adjustment, the push rod motor drives the support member to move up and down, thereby driving the adjusting ring to move up and down to push the branches to rotate for angle adjustment.

8 Claims, 4 Drawing Sheets

CHRISTMAS TREE WITH SHAPE CHANGEABLE BY ADJUSTING ANGLE OF BRANCHES

TECHNICAL FIELD

The present disclosure relates to a Christmas tree, in particular to a Christmas tree with a shape changeable by adjusting an angle of branches.

BACKGROUND

At Christmas, all kinds of Christmas trees can be seen everywhere on various occasions. Some Christmas trees are decorated with real trees, but most of Christmas trees are artificial Christmas trees formed by plastic injection molding. On these trees, all kinds of bells, bright balls, gifts and small light bulbs are hung and tied for decoration. Although these structures can also achieve some ornamental and decorative effects, the angle of an existing Christmas tree is adjusted manually in general, and the angle of branches cannot be adjusted arbitrarily and automatically as needed.

SUMMARY

The present disclosure aims to solve the problem that branches of an existing Christmas tree cannot be automatically adjusted in angle.

In order to solve the technical problem raised in the present disclosure, the following technical solution is adopted: a Christmas tree with a shape changeable by adjusting an angle of branches, including a base, a column arranged on the base, and one or more layers of branches arranged on the column, where branch fixing frames are arranged around the column; the branches are rotatably arranged on the branch fixing frames; the base is provided with a branch adjusting structure for adjusting the angle of the branches; the branch adjusting structure includes an adjusting frame movably sleeved outside the column, a support member for supporting the adjusting frame, and a push rod motor for driving the support member to move up and down to push the branches for angle adjustment; the push rod motor is arranged on the base; an adjusting ring is arranged at a position, corresponding to a lower part of each of the layers of branches, of the adjusting frame; the adjusting ring at the bottom is positioned on the support member; and a lower part of the column is connected with the base via a column support frame.

The technical solution for further limiting the present disclosure includes:

The lower part of the column is connected with the base via the inverted L-shaped column support frame; the bottom of a long side of the inverted L-shaped column support frame is connected with the base; the column is fixedly connected with the top of the inverted L-shaped column support frame; the support member is positioned below a short side of the inverted L-shaped column support frame; and the column support frame is lower than a top surface of the support member.

The cross section of the support member is a rectangular frame with an opening in the top; and the short side of the inverted L-shaped column support frame is positioned in the rectangular frame.

The column support frame is detachably connected with the base; a bottom end of the column support frame is provided with a cylindrical installation end; the cylindrical installation end is provided with an elastic telescopic column; the base is provided with a cylindrical installation hole matched with the cylindrical installation end; and the cylindrical installation hole is provided with a clamping and fixing hole matched with the elastic telescopic column.

The base is provided with a push rod sleeve matched with a push rod of the push rod motor; and the push rod of the push rod motor is slidably arranged in the push rod sleeve.

The adjusting ring at the bottom is provided with one or more support screws; and the remaining adjusting rings are formed with threaded holes matched with the support screws.

Two or more layers of adjusting rings are evenly installed on the support screws in an up-down manner.

Each of the branch fixing frames is formed with obliquely upward fixing grooves evenly formed along the center of the column; each of the fixing grooves is internally provided with a branch; and the branch is rotatably connected with the given fixing groove via a hinge shaft arranged in the given fixing groove.

An installation end of the branch is made of a metal wire; and one end of the metal wire is bent to form an installation ring rotatably matched with the hinge shaft.

The bottom of the base is provided with support legs.

Via the above technical solution, the present disclosure has the following beneficial effects: when the angle of the Christmas tree with a shape changeable by adjusting an angle of branches in the present disclosure is adjusted, the push rod motor drives the support member to move up and down, thereby driving the adjusting ring to move up and down to push the branches to rotate for angle adjustment. Therefore, the angle of the branches can be automatically and arbitrarily adjusted within a certain range to meet different decorative needs of people.

DETAILED DESCRIPTION OF THE EMBODIMENTS

The structure of the present disclosure is further described below with reference to the accompanying drawings.

Figure 1:
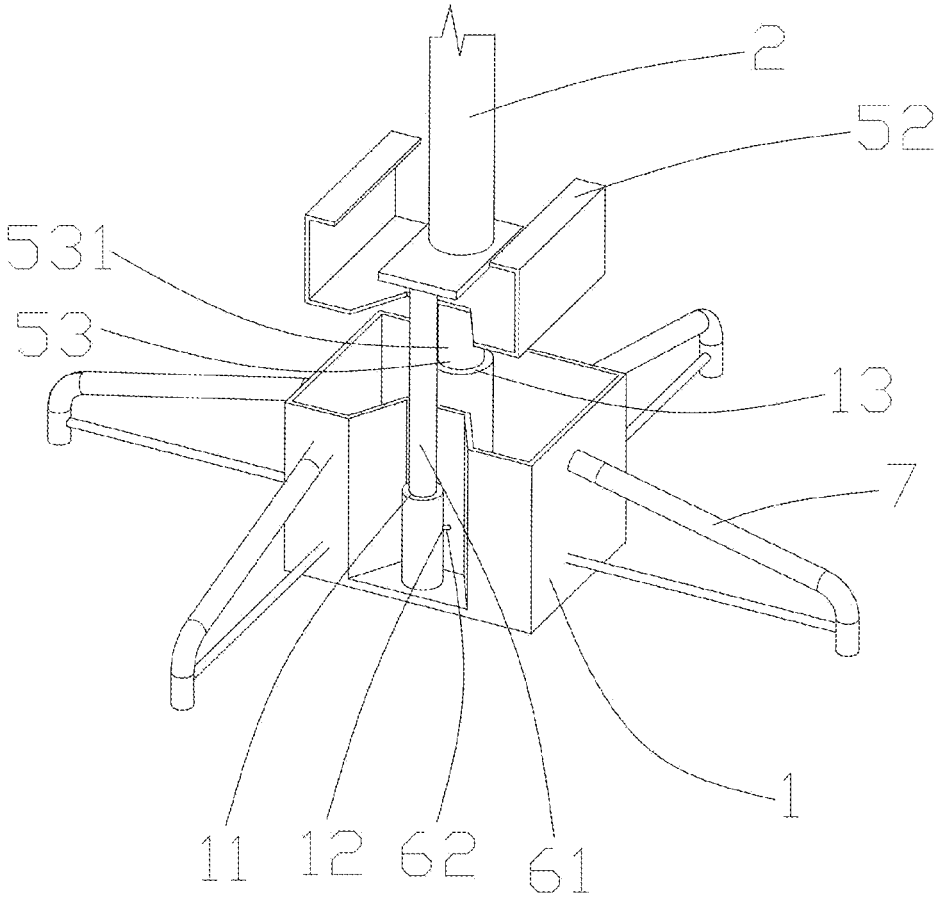
FIG. 1 is a schematic diagram of an assembly structure of a Christmas tree with a shape changeable by adjusting an angle of branches in the present disclosure.
Figure 2:
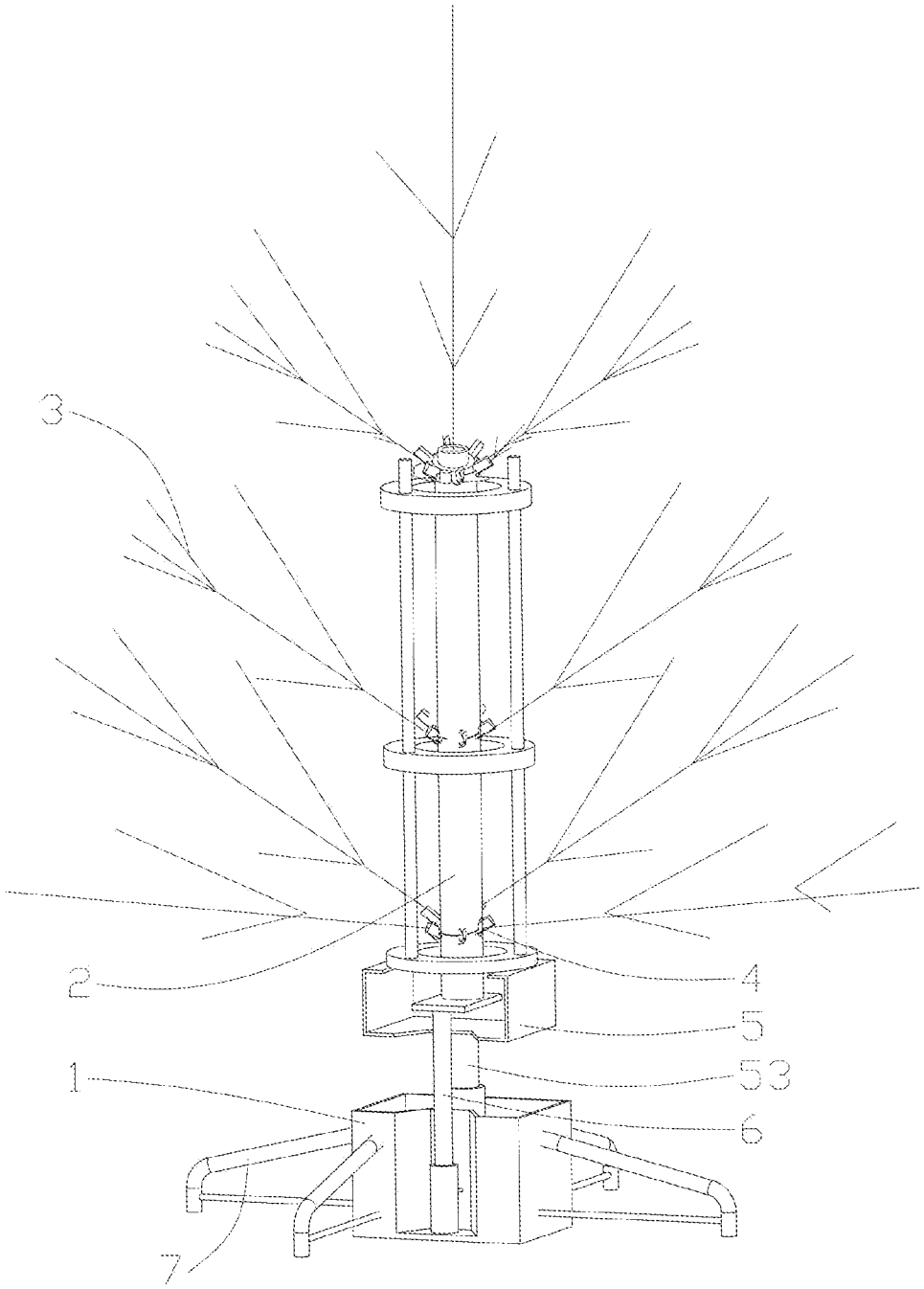
FIG. 2 is a schematic diagram of a branch adjusting structure of the Christmas tree with a shape changeable by adjusting an angle of branches in the present disclosure.
Figure 3:
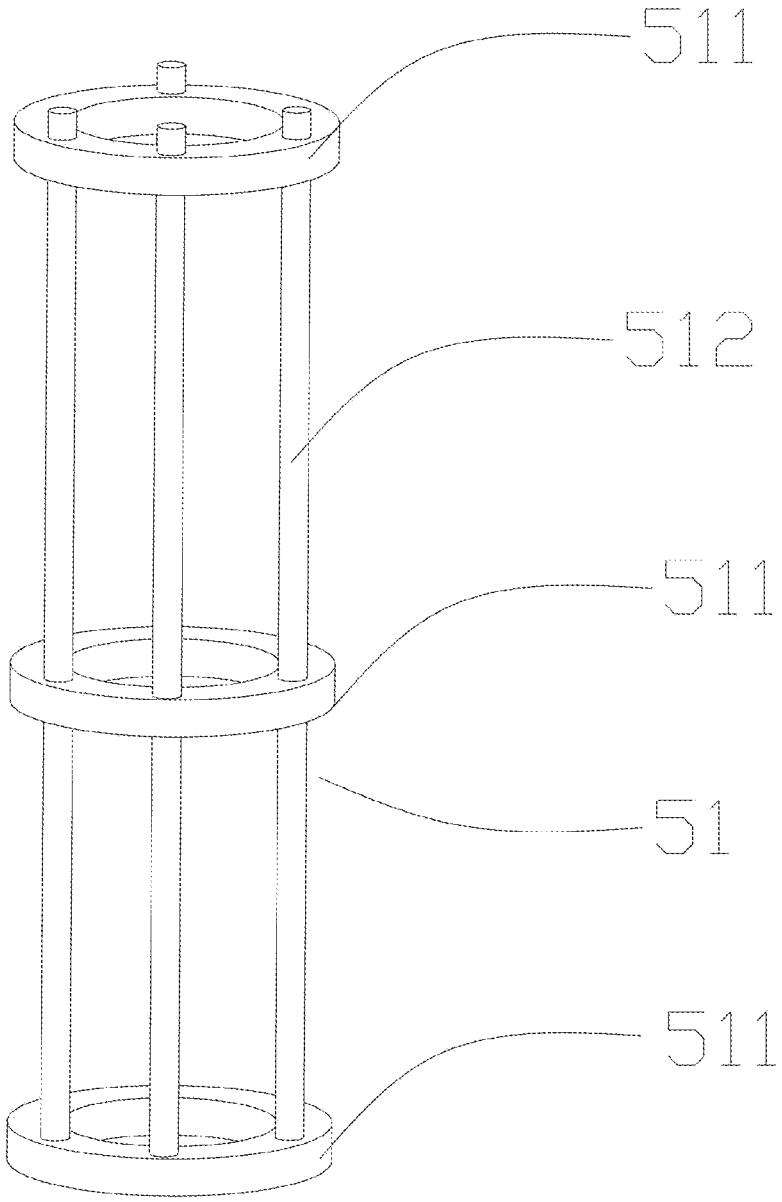
FIG. 3 is a schematic structural diagram of an adjusting frame of the Christmas tree with a shape changeable by adjusting an angle of branches in the present disclosure.
Figure 4:
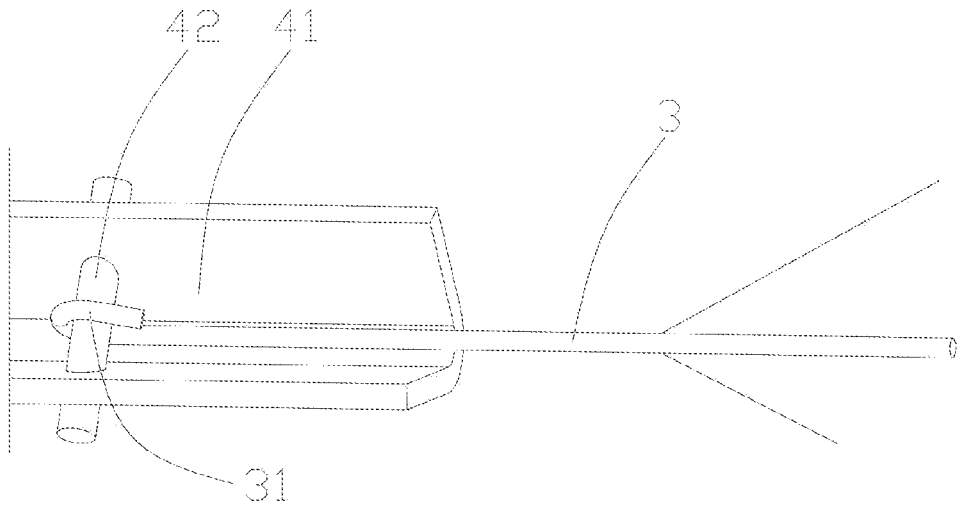
FIG. 4 is a schematic diagram of a branch installation structure of the Christmas tree with a shape changeable by adjusting an angle of branches in the present disclosure.

Referring to FIG. 1 to FIG. 4, a Christmas tree with a shape changeable by adjusting an angle of branches includes a base 1, a column 2 arranged on the base, and one or more layers of branches 3 arranged on the column, where branch fixing frames 4 are arranged around the column; the branches are rotatably arranged on the branch fixing frames; the base is provided with a branch adjusting structure 5 for adjusting the angle of the branches; the branch adjusting structure 5 includes an adjusting frame 51 movably sleeved outside the column, a support member 52 for supporting the adjusting frame, and a push rod motor 53 for driving the support member to move up and down to push the branches for angle adjustment; the push rod motor is arranged on the base; an adjusting ring 511 is arranged at a position, corresponding to a lower part of each of the layers of branches, of the adjusting frame 51; the adjusting ring at the bottom is positioned on the support member; and a lower part of the column is connected with the base via a column support frame 6. When the angle of the Christmas tree is adjusted, the push rod motor drives the support member to move up and down, thereby driving the adjusting ring to move up and down to push the branches to rotate for angle adjustment. Therefore, the angle of the branches can be automatically and arbitrarily adjusted within a certain range to meet different decorative needs of people.

In this embodiment, the lower part of the column is connected with the base via the inverted L-shaped column support frame 6; the bottom of a long side of the inverted L-shaped column support frame is connected with the base; the column is fixedly connected with the top of the inverted L-shaped column support frame; the support member is positioned below a short side of the inverted L-shaped column support frame; and the column support frame is lower than a top surface of the support member. The cross section of the support member is a rectangular frame with an opening in the top; and the short side of the inverted L-shaped column support frame is positioned in the rectangular frame. Thus, the structure is simple and compact, and space is saved.

In this embodiment, the column support frame is detachably connected with the base; a bottom end of the column support frame 6 is provided with a cylindrical installation end 61; the cylindrical installation end is provided with an elastic telescopic column 62; the base 1 is provided with a cylindrical installation hole 11 matched with the cylindrical installation end; and the cylindrical installation hole is provided with a clamping and fixing hole 12 matched with the elastic telescopic column. When the column support frame is installed, the elastic telescopic column 62 is pressed, and the elastic telescopic column is inserted into the cylindrical installation hole together with the cylindrical installation end. When the elastic telescopic column is aligned with the clamping and fixing hole, the elastic telescopic column is automatically ejected and clamped in the clamping and fixing hole, thereby fixing the column support frame. During disassembly, the column support frame can be pulled out only by pressing the elastic telescopic column, such that disassembly and use are convenient.

In this embodiment, the base 1 is provided with a push rod sleeve 13 matched with a push rod of the push rod motor; and the push rod 531 of the push rod motor 53 is slidably arranged in the push rod sleeve. The push rod of the push rod motor moves up and down to push the support member to move up and down, thereby driving the adjusting ring to move up and down to push the branches to rotate for angle adjustment.

In this embodiment, the adjusting ring at the bottom is provided with one or more support screws 512; and the remaining adjusting rings are formed with threaded holes matched with the support screws. During specific implementation, two or more layers of adjusting rings may be evenly installed on the support screws in an up-down manner. The adjusting rings are screwed with the support screws by installing the threaded holes; and the distance between the adjusting rings may also be freely adjusted according to the distance between the two layers of branches.

In this embodiment, each of the branch fixing frames 4 is formed with obliquely upward fixing grooves 41 evenly formed along the center of the column; each of the fixing grooves is internally provided with a branch 3; and the branch 3 is rotatably connected with the given fixing groove via a hinge shaft 42 arranged in the given fixing groove. An installation end of the branch 3 is made of a metal wire; and one end of the metal wire is bent to form an installation ring 31 rotatably matched with the hinge shaft. Thus, the branch may rotate on the hinge shaft. The adjusting ring is arranged at a position corresponding to a lower part of each of the layers of branches. When the adjusting ring moves up, the branch is driven to rotate upward to adjust the angle upward. When the adjusting ring moves down, the branch rotates downward under the action of gravity to adjust the angle downward. Therefore, the angle of the branches can be automatically and arbitrarily adjusted within a certain range to meet different decorative needs of people.

In this embodiment, the bottom of the base is provided with support legs 7. The support legs are formed by bending steel wires and configured to support the base.

Although the specific embodiments of the present disclosure have been described in detail with reference to the accompanying drawings, it should not be construed as limiting the scope of protection of the present disclosure. Within the scope described in the claims, various modifications and variations made by those skilled in the art without creative efforts still belong to the scope of protection of the present disclosure.

The invention claimed is:

1. A Christmas tree with a shape changeable by adjusting an angle of branches, comprising a base, a column having an upper part and a lower part arranged on the base, and one or more layers of branches arranged on the column;

wherein the lower part of the column is connected with the base via an inverted L-shaped column support frame having a long side and a short side such that a bottom end of the long side of the inverted L-shaped column support frame adjoins the base and the column is fixedly connected to a top surface of the short side of the inverted L-shaped column support frame;

wherein branch fixing frames are arranged around the column, the branches are rotatably arranged on the branch fixing frames;

wherein the base is provided with a branch adjusting structure for adjusting the angle of the branches;

the branch adjusting structure comprises an adjusting frame movably sleeved outside the column and including adjusting rings arranged at positions corresponding to a lower part of each layer of branches, a support member for supporting the adjusting frame, and a push rod motor arranged on the base and attached to the support member for driving the support member to move up and down to push the branches for angle adjustment;

wherein the bottommost adjusting ring is positioned on the support member; and wherein the support member is a rectangular frame having a top with an opening and a bottom, and the short side of the inverted L-shaped column support frame is positioned in the rectangular frame such that the L-shaped column support frame is lower than the top of the rectangular frame, and the bottom of rectangular frame is positioned below the short side of the inverted L-shaped column support frame.

2. The Christmas tree with a shape changeable by adjusting an angle of branches according to claim 1, wherein the inverted L-shaped column support frame is detachably connected with the base; the bottom end of the inverted L-shaped column support frame is provided with a cylindrical installation end; the cylindrical installation end is provided with an elastic telescopic column; the base is provided with a cylindrical installation hole matched with the cylindrical installation end; and the cylindrical installation hole is provided with a clamping and fixing hole matched with the elastic telescopic column.

3. The Christmas tree with a shape changeable by adjusting an angle of branches according to claim 1, wherein the base is provided with a push rod sleeve matched with a push rod of the push rod motor; and the push rod of the push rod motor is slidably arranged in the push rod sleeve.

4. The Christmas tree with a shape changeable by adjusting an angle of branches according to claim 1, wherein the bottommost adjusting ring is provided with one or more support screws; and the remaining adjusting rings are formed with threaded holes matched with the support screws.

5. The Christmas tree with a shape changeable by adjusting an angle of branches according to claim 4, wherein two or more layers of adjusting rings are evenly installed on the support screws in an up-down manner.

6. The Christmas tree with a shape changeable by adjusting an angle of branches according to claim 1, wherein each of the branch fixing frames is formed with obliquely upward fixing grooves evenly formed along the center of the column and each of the fixing grooves is internally provided with a branch that is rotatably connected with the given fixing groove via a hinge shaft arranged in the given fixing groove.

7. The Christmas tree with a shape changeable by adjusting an angle of branches according to claim 6, wherein an installation end of the branch is made of a metal wire; and one end of the metal wire is bent to form an installation ring rotatably matched with the hinge shaft.

8. The Christmas tree with a shape changeable by adjusting an angle of branches according to claim 1, wherein the bottom of the base is provided with support legs.

* * * * *